United States Patent [19]

Schuetzeberg

[11] Patent Number: 4,733,897

[45] Date of Patent: Mar. 29, 1988

[54] BOOT HANDLE

[76] Inventor: Roy L. Schuetzeberg, 3206 67th St., Lubbock, Tex. 79413

[21] Appl. No.: 34,857

[22] Filed: Apr. 3, 1987

[51] Int. Cl.[4] ..... B65D 71/00

[52] U.S. Cl. ..... 294/162; 211/34; 211/37

[58] Field of Search ..... 294/162, 146, 148, 145, 294/151, 163, 165; 224/917; 211/34, 37; 12/120.5; 206/315.1

[56] References Cited

U.S. PATENT DOCUMENTS

| | | | |
|---|---|---|---|
| 3,537,594 | 11/1970 | Daley | 294/162 |
| 3,600,734 | 8/1971 | Pollinger | 294/162 |
| 3,608,795 | 9/1971 | Klein et al. | 294/162 |

*Primary Examiner*—James B. Marbert
*Attorney, Agent, or Firm*—Wendell Coffee

[57] ABSTRACT

Each ski boot of a pair will have a toe notch and a heel notch so that each pair of boots will have four notches. Boot carriers have four rigid members which fit into the four notches on ski boots. The members engaging the heel notches are connected to one end of an elastic assembly, and the member connecting to the toe notches are connected to the other end of an elastic assembly. The elastic assembly between the soles of the two boots will pull the boots so that they are held together at the soles. A handle is connected to the members engaged in the notches at one end to provide for a carrier for the boots.

3 Claims, 4 Drawing Figures

BOOT HANDLE

RIGHTS TO INVENTIONS UNDER FEDERAL RESEARCH

There was no federally sponsored research and development concerning this invention.

BACKGROUND OF THE INVENTION (1) Field of the Invention

This invention relates to skiing, and more particularly to a carrier for carrying a pair of ski boots.

(2) Description of the Related Art

Those engaged in downhill skiing are familiar with the fact that the boots are heavy, clumsy, and difficult to carry when they are not being worn. When used herein, "boots", refers to ski boots used in downhill skiing.

Carriers or holders have been developed for ski boots which have rigid framework which extends between the soles of the boots. Generally these carriers also include a flat stand so that when the boots are in the carriers, the boots can be stored on a shelf in an erect position. They are excellent for the store keeper.

However, for the individual skier, rigid boot carriers have a disadvantage. When the skier puts the boots on at the slope, he must store the boot carrier. I.e., the boot carrier itself is too clumsy to carry while skiing.

SUMMARY OF THE INVENTION (1) Progressive Contribution to the Art

I have invented a carrier which, when not in use, can be folded into a compact package and carried with the skier while on the slopes skiing. Specifically, the carrier can be folded to fit in a pouch which is less than 5" wide and 5" deep, and no more than 1½" in thickness. It will be understood that normally a skier can put such a pouch on his person. Furthermore, a strap on the pouch provides ability to attach the pouch on the clothing of the skier.

The carrier includes two rubber bands which hold notch pieces. The notch pieces fit into the toe and heel notches found on ski boots. The notch pieces hold the carrier tight to the boots and hold the boots tight to one another. A strap is attached to one end of the rubber bands to help stretch the bands when placing the carrier upon the boots. A handle is provided to carry the boots.

(2) Objects of this Invention

An object of this invention is to provide a carrier for ski boots which can be folded into a small packet when not attached to the boots.

Further objects are to achieve the above with a device that is sturdy, compact, durable, lightweight, simple, safe, efficient, versatile, ecologically compatible, energy conserving, and reliable, yet inexpensive and easy to manufacture, attach, and maintain.

Other objects are to achieve the above with a method that is rapid, versatile, ecologically compatible, energy conserving, efficient, and inexpensive, and does not require skilled people to attach, and maintain.

The specific nature of the invention, as well as other objects, uses, and advantages thereof, will clearly appear from the following description and from the accompanying drawing, the different views of which are not scale drawings.

Figure 1:
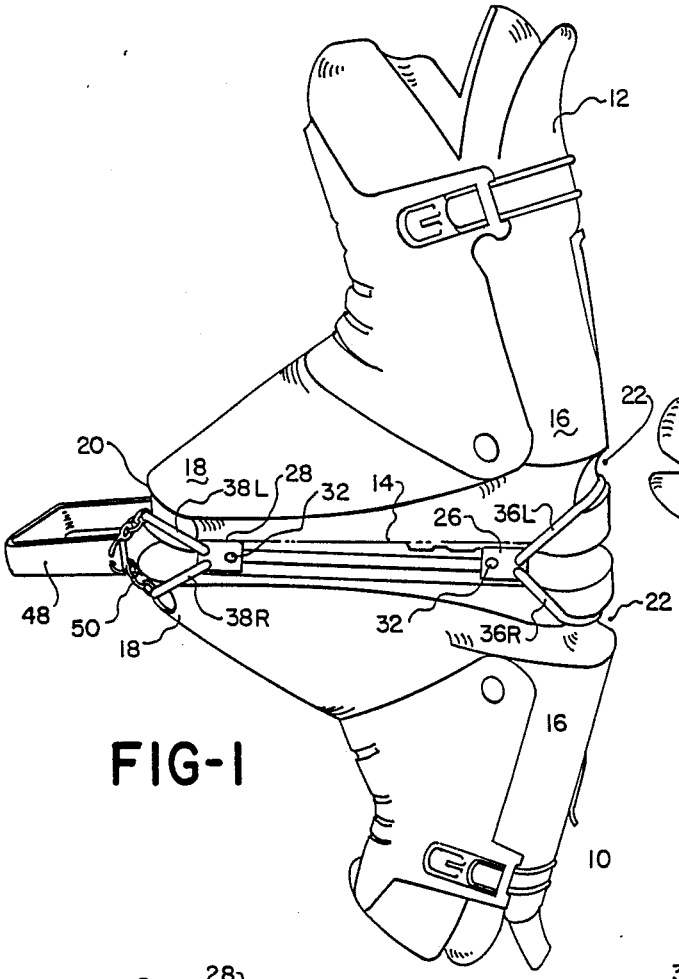
FIG. 1 is a perspective view of a carrier according to this invention attached to a pair of ski boots.

As an aid to correlating the terms of the claims to the exemplary drawing, the following catalog of elements is provided:

10 right boot
12 left boot
14 sole
16 heel
18 toe
20 toe notch
22 heel notch
24 rubber bands
26 distal end bar
28 handle end bar
30 opening
32 pin
34 elastic assembly
36 distal notch piece—right and left
38 handle notch piece—right and left
40 arcuate side
42 straight sides
44 open side
46 strap
48 handle
50 flex connection
52 pouch
54 Velcro
56 carrying ring

DESCRIPTION OF THE PREFERRED EMBODIMENT

Referring to the drawings, there may be seen a pair of ski boots 10 and 12. It will be recognized that a pair of ski boots includes right boot 10 and left boot 12. Each of the ski boots will have flat rigid sole 14. Also, each boot will have heel 16 and toe 18. Toe notch 20 and heel notch 22 are provided for the bindings so that the boots may be attached to skies when in use.

The carrier to carry the boots includes two rubber bands 24. Although the bands are referred to as rubber, it will be understood that they could be made of any elastic material. The rubber bands are attached to a rigid distal end bar 26 and a rigid handle end bar 28. As may be seen in the drawings, the rigid end bars have openings 30 in one side for the end of the rubber bands. Metal pin 32 extends through the rigid end bars to hold the rubber bands 24 in openings 30. The two rubber bands and to the distal and handle end bars form elastic assembly 34. It will be noted that the bar ends 26 and 28 are pivoted to the rubber bands 24 by the pins 32.

The outside sides of end bars 26 and 28 have notch pieces attached thereto. There will be a total of four notch pieces, two distal notches pieces 36 and two handle notch pieces 38. Each notch piece is made of heavy metal wire or light metal rods. Each of the notch pieces has basically a rectangular configuration. Basically the notch piece includes a notch or arcuate or curved side 40 connected by two short straight sides 42 to elastic side or broken side or open side 44. The open side 44 extends through a hole in the outside side of the end bars 26 and 28. Therefore, it may be seen in the drawings that pieces 36 and 38 are pivoted to end bars 26 and 28. Stated otherwise, pieces 36 and 38 are pivoted to the elastic assembly. The elastic assembly and the notch pieces 36 and 38 form an attachment assembly.

The handle end bar 28 includes an opening on the outside side to which fabric strap 46 is attached. Handle notch pieces 38 have three sided handle 48 attached thereto. The handle is attached by flexible connections 50. The flexible connections are in the form of two chain links. It may be said that the handle 48 is attached to the attachment assembly at a handle area, which is the area at or near the handle end bar 28.

Figure 2:
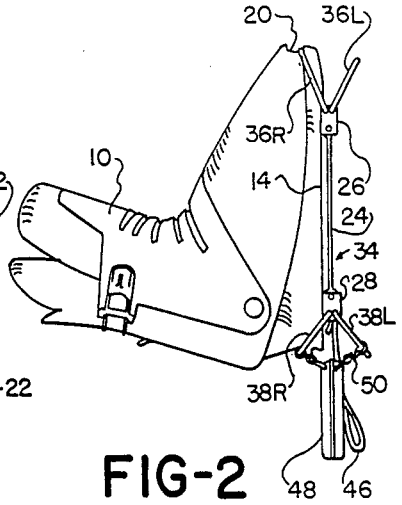
FIG. 2 shows the carrier as it is attached to one boot.
Figure 3:
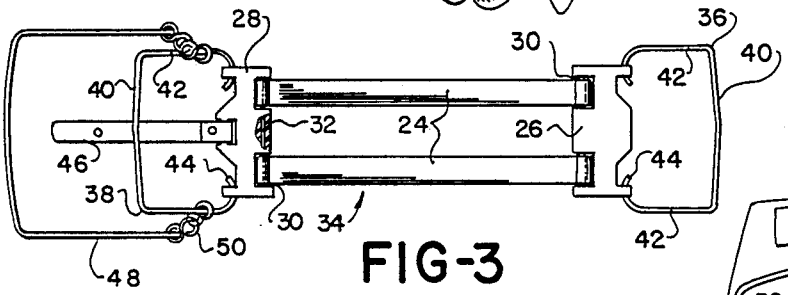
FIG. 3 is a top plan view of the carrier laid flat and detached from the boots.

Reference is made to FIG. 2 illustrating placing the carrier upon the right boot 10. Although the carrier is completely reversible, for the purpose of explaining the procedure of applying to the boot, the two distal pieces 36 will be designated as the right distal notch piece 36R and the left distal notch piece 36L. Likewise, the handle notch pieces will be designated as 38R and 38L.

First, the right distal notch piece 36R is placed in one of the notches. This could either be toe notch 20 or heel notch 22; however, it has been illustrated as being placed in toe notch 20. After this is done, elastic assembly 34 is stretched preferably by pulling on strap 46. Then, right handle notch piece 38R is placed within the other notch, which in this case will be heel notch 22. As will be seen, elastic assembly 34 will hold the elastic assembled against flat sole 14. Thereafter, left distal notch piece 36L is placed in one of the notches, such as toe notch 20, of the left boot. Then, elastic assembly 34 is again stretched by pulling on strap 46, and left handle notch piece 38L is placed in the other notch of the left boot.

It may be seen that according to FIG. 2, the handle notch pieces 38 are in the heel notches 22. However, FIG. 1 illustrates the carrier attached to the pair of boots with the distal notch pieces 36 placed in the heel notches 22. Also, it will be seen that when the carrier is attached to both notches, that the elastic assembly 34 not only holds the notch pieces 36 and 38 securely in the notches 20 and 22, but also holds the soles 14 securely against the elastic assembly 34. I.e., the boots are held together and also held securely upon the carrier. It may be seen that with the handle attached to the straight sides 42 of handle notch pieces 48, that the weight of the boot and the tension of flexible connectors 50 will also tend to pull the boots together and hold them together as a unit.

Figure 4:
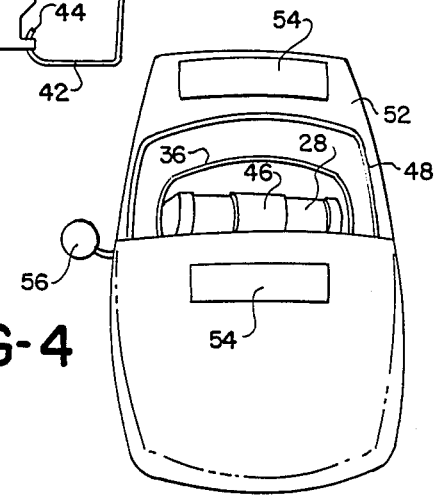
FIG. 4 is a top plan view of the carrier completely folded with a pouch for carrying.

FIG. 4 illustrates the carrier removed and folded partially within the confines of the fabric pouch 52. The pouch may be conveniently closed by Velcro type patches 54. Also, it may be seen that pieces 36 and 38, as well as elastic assembly 34, are folded within the confines of handle 48. As stated before, this is a packet less than 5" wide, 5" tall, and 1½" thick.

Carrying ring 56 is attached to the pouch 52. The ring may be used in connection with a snap to attach it to the clothing of the skier.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A carrier for a pair of ski boots, said boots being a right and left boot, each of said boots having:

a. a heel and a toe,
b. a flat rigid sole,
c. a toe notch across the toe for ski bindings, and
d. a heel notch across the heel for ski bindings;

wherein the improved carrier comprises:

e. two distal notch pieces,
f. two handle notch pieces,
g. each notch piece being:
  i. rigid,
  ii. of general rectangular shape with
  iii. a notch side,
  iv. an elastic side opposite the notch side, and
  v. two straight sides connecting the notch side and elastic side,
h. the notch side on each notch piece adapted to fit one of the notches of the boots,
j. an elastic assembly having a distal and handle end,
k. the elastic sides of the two distal notch pieces rotatably connected to the distal end of the elastic assembly,
l. the elastic sides of the two handle notch pieces rotatably connected to the handle end of the elastic assembly,
m. a handle,
n. two tension members on each side of the handle,
o. each of said tension members attached to one of the straight sides of one of the handle notch pieces, and
p. a strap connected to the handle end of the elastic assembly.

2. The invention as defined in claim 1 wherein said elastic assembly includes:

q. two parallel rubber bands,
r. a rigid end bar at each end with the rubber bands connected thereto,
s. the elastic side of the notch pieces pivoted to the rigid end bars, so that when the carrier is connected to a pair of ski boots, the elastic assembly is completely between the soles of the ski boots.

3. The process of carrying a pair of ski boots, said pair being a right and left boot, each of said boots having:

a. a heel and a toe,
b. a flat rigid sole,
c. a toe notch across the toe for ski bindings, and
d. a heel notch across the heel for ski bindings, wherein the improved method comprises:

e. attaching a right distal notch piece to one of the notches of the right boot, and
f. attaching a right handle notch piece to the other notch of the right boot,
g. biasing the right notch pieces toward one another by an elastic piece extending along the sole of the right boot,
h. attaching a left distal notch piece to one of the notches of the left boot, and
i. attaching a left handle notch piece to the other notch of the left boot,
j. biasing the left toe and heel pieces toward one another by said elastic piece with the boots toe to toe and heel to heel, and
k. carryiing the boots by a handle attached to the two handle notch pieces, thereby
l. pulling the handle notch pieces together by the weight of the boots and the attachment of the handle thereto.

* * * * *